United States Patent [19]

Takayama

[11] Patent Number: 4,701,043

[45] Date of Patent: Oct. 20, 1987

[54] IMAGE FORMING APPARATUS

[75] Inventor: Kenzo Takayama, Tokyo, Japan

[73] Assignee: Canon Kabushiki Kaisha, Tokyo, Japan

[21] Appl. No.: 614,762

[22] Filed: May 29, 1984

[30] Foreign Application Priority Data

May 31, 1983 [JP] Japan ..... 58-96384

[51] Int. Cl.[4] ..... G03G 15/09

[52] U.S. Cl. ..... 355/3 DD; 355/14 D; 118/647; 118/657; 118/658

[58] Field of Search ..... 355/3 DD, 14 D, 14 C; 430/102, 103, 122, 123; 118/621, 623, 625, 647, 651, 656-658; 222/DIG. 1; 358/300

[56] References Cited

U.S. PATENT DOCUMENTS 4,042,962 8/1977 Yamaji ..... 355/3 R X 4,102,305 7/1978 Schwarz ..... 118/651

4,239,374 12/1980 Tatsumi et al. ..... 355/14 D X 4,292,387 9/1981 Kanbe et al. ..... 430/122 X 4,348,100 9/1982 Snelling ..... 355/14 D X 4,395,476 7/1983 Kanbe et al. ..... 430/102

4,482,243 11/1984 Suzuki et al. ..... 355/14 D

*Primary Examiner*—Arthur T. Grimley

*Assistant Examiner*—J. Pendegrass

*Attorney, Agent, or Firm*—Fitzpatrick, Cella, Harper & Scinto

[57] ABSTRACT

An image forming apparatus selectively operable in either a first mode for obtaining a photocopy of an original or a second mode for recording information signals. The apparatus includes a developing device for developing an electrostatic latent image formed on an electrophotographic type photosensitive member, and the characteristic of the developing device can be changed in accordance with the selected mode.

3 Claims, 8 Drawing Figures

IMAGE FORMING APPARATUS

BACKGROUND OF THE INVENTION

The present invention relates to an image forming apparatus selectively operable in either a first mode for obtaining a photocopy of an original or a second mode for recording information signals outputted from computers, word processors, facsimile transmitters or the like.

An example of such image forming systems is disclosed in U.S. Pat. No. 4,042,962.

The applicant has found some problems peculiar to such type of image forming systems. That is, when an original is to be copied, the reproducibility of halftone should be superior for ensuring good tone reproduction in the resultant copy image. This is very important, for example, when an original having a halftone such as a photograph is to be copied. This importance can be understood from FIG. 1.

FIG. 1 shows curves representing the relationship between the density $D_o$ of an original and the density $D_c$ of a reproduced (copied) image. These curves will be called $D_o-D_c$ curves. Symbols $D_W$, $D_{H1}$, $D_{H2}$ and $D_B$ on $D_o$ axis represent densities in the white area, first and second halftone areas and black area on the original, respectively. In FIG. 1, the curve A shows that the tone reproducibility is satisfactory.

If the $D_o-D_c$ curve follows the curve A, the halftone can faithfully be reproduced in the image. However, if the $D_o-D_c$ curve follows the curve B, the halftone area $D_{H2}$ is reproduced into a substantially black area, so that an original including a halftone such as a photograph will be reproduced into very a hard-tone image.

On the other hand, where electrical information signals outputted from a computer, word processor, facsimile transmitter or the like are to be converted into images, the required characteristics of development are very different from the above characteristics of development with respect to reproduction. Most of the images to be outputted in such mode comprise letters, figures, symbols or the like which are to be recorded in the form of binary signals corresponding to white and black colors. It also has been attempted to record the white background, halftone area and black background by the use of trinary signals. In order to obtain a high-quality image having a halftone by the use of such digital signals, there can be used Dither method, Density Pattern method and others which are based on an integration effect in the human's eyes which feel the density of the image from a proportion of black-colored picture elements occupying a very small area.

Thus, the characteristics of development required in the mode in which an image is to be obtained on the basis of information signals do not need to be such as denoted by curve A shown in FIG. 1. However, images having no fog are more severely required than in the copy mode. It can be understood from FIG. 1 that the curve B is preferable rather than the curve A, since the former has a higher latitude with respect to fog.

In the image forming apparatus having a function for copying originals and another function for recordingly converting information signals into images, the use of the same developing device in both of these modes would provide a very hard-tone image.where the characteristics of development is set to be optimum for the information recording mode and if an original having a halftone is to be copied. On the contrary, where the characteristics of development is set to be optimum for copying originals having halftone, the latitude would be reduced with respect to fog in the case of information recording.

SUMMARY OF THE INVENTION

It is therefore an object of the present invention to provide an improved image forming apparatus which is selectively operable in either a mode in which an original is to be copied or in another mode in which information signals are to be recorded.

Another object of the present invention is to provide an image forming apparatus which can obtain good images in both the above modes.

Still another object of the present invention is to provide an image forming apparatus which can form an image having good halftone in the mode in which an original is to be copied and can form an image having no fog in the mode in which information signal are to be recorded.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
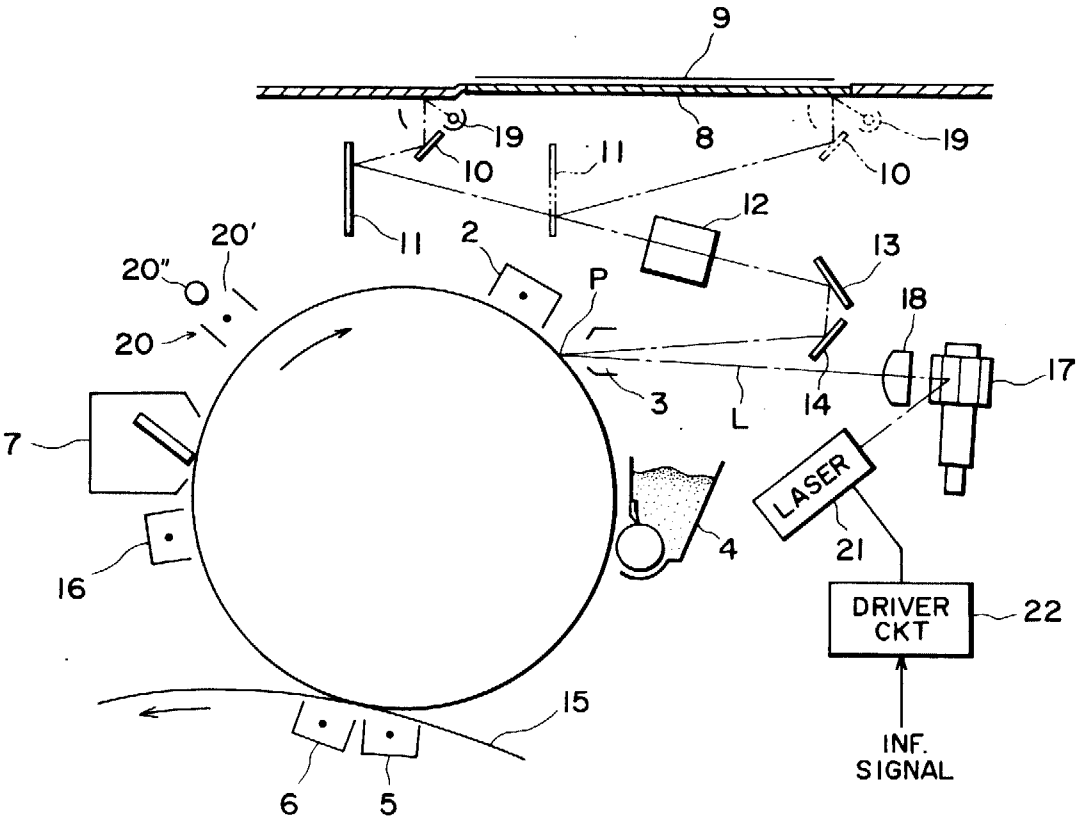
FIG. 2 shows an embodiment of the present invention.

Referring now to FIG. 2, there is shown an image forming apparatus having an electrophotographic type photosensitive member in the form of a drum 1 which is rotated in the direction of arrow and comprises an electrically conductive layer, a photoconductive layer and surface insulation layer. Around the periphery of the drum 1 there are disposed chargers 2 and 3, a developing device 4, a transfer charger 5, a separation charge remover 6, a toner charge remover 16, a cleaning device 7 and a photosensitive member charge remover 20 in the described order. The image forming apparatus also includes a transparent carrier 8 on which an original 9 is placed, an original scanning mirror 10 movable parallel to the carrier 8 between a solid-line position and a broken-line position in a mode in which the original is to be copied, a mirror 11 adapted to move at a speed one-half that of the mirror 10, an imaging lens 12, fixed mirrors 13 and 14, and an original illuminating lamp 19 which is lighted on in the original copy mode. The image forming apparatus further includes a semiconductor laser 21, a drive circuit 22 for driving the semiconductor laser 21 in accordance with information signals to be recorded, in a mode in which information signals are to be recorded, a rotary polygonal mirror 17 rotatable to scanningly displace the laser beam L in the information recording mode, and a lens 18 for imaging the laser beam in the form of a spot on the photosensitive member 1.

In such an arrangement, the photosensitive member 1 is first charged uniformly, for example, into the positive polarity by the charger 2 in either of the original copy mode or information recording mode.

In the original copy mode, the original 9 is scanned by the scanning mirrors 10 and 11 to form a light image which is in turn imaged on the photosensitive member 1 through the above optical system 10 to 14 to form an electrostatic latent image thereon at the exposure location P.

In the information recording mode, the semiconductor laser 21 is driven by the drive circuit 22 in accordance with the electrical digital information signals outputted from a signal source such as a computer, word processor, facsimile transmitter and other. Thus, the laser 21 emits a laser beam L which is modulated in accordance with the information signals. This laser beam L scans the photosensitive member 1 through the polygonal mirror 17 at the location P. Thus, an electrostatic latent image corresponding to the information signals will be formed on the photosensitive member 1. In the information recording mode, the region of the photosensitive member 1 on which toner is not to be deposited is exposed to light, similarly as in the original copy mode. In other words, the background of an image formed on the photosensitive member 1 is exposed to the laser beam L.

In both of the original copy mode and information recording mode, the electrostatic latent image formed on the photosensitive member 1 is developed by the developing device 4 which is adapted to supply the photosensitive member 1 with one-component developer (toner) charged into the polarity opposite to that of the charger 2. The toner is electrostatically attracted to the dark potential region of the photosensitive member 1, that is, the region which has not been radiated by the light. As will be described hereinafter, the developing device 4 includes a development electrode which is positioned opposed to the photosensitive member 1 and adapted to carry the toner thereto, and an alternating voltage is applied to the development electrode as a development bias voltage. Thus, the toner particle will reciprocate between the development electrode and the photosensitive member 1 such that the toner will be attracted to the dark potential region of the photosensitive member by an amount corresponding to that potential. Such a developing device is disclosed, for example, in U.S. Pat. No. 4,395,476.

In any event, the toner image formed on the photosensitive member 1 is then transferred onto a sheet of paper 15 under the action of the transfer charger 5. The paper 15 is then charge-removed by the separation discharger 6 and separated from the photosensitive member 1. Thereafter, the paper 15 is moved to a fixing device (not shown) whereat the toner image is fixed to the paper 15. On the other hand, the toner remaining on the photosensitive member 1 after the transfer step is charge-removed by the charge remover 16 and completely removed from the photosensitive member 1 by means of the cleaning device 7. Finally, the photosensitive member 1 is subjected to A.C. corona discharge from a discharger 20' while being radiated by a lamp 20''. This removes the remaining charge from the photosensitive member 1.

The toner charge remover 16 is not necessarily required. Also, where the photosensitive member 1 includes an electrical conductive substrate and a photoconductive surface layer thereover, the above means 3 and 20' may be omitted.

Figure 3:
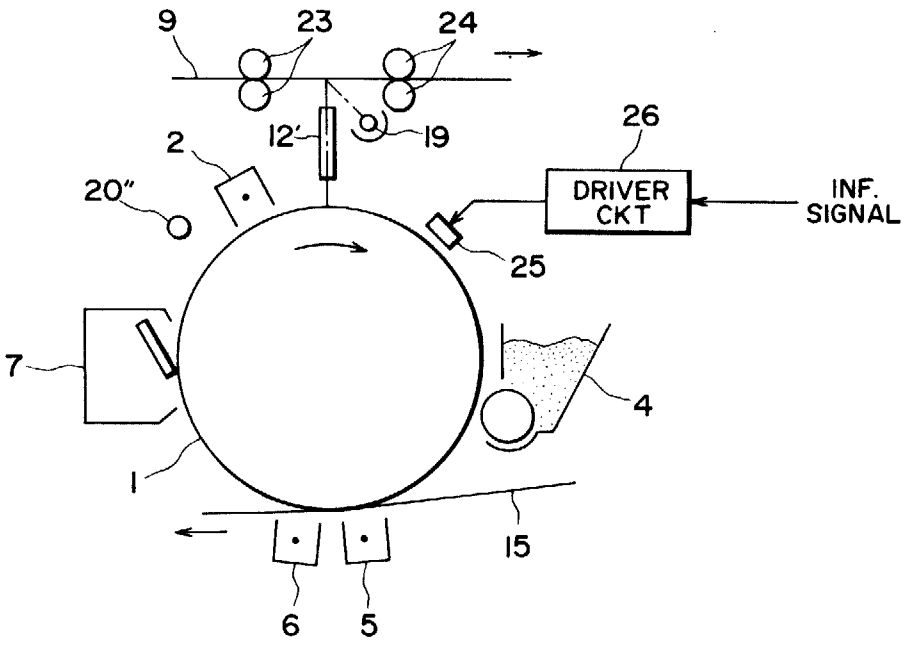
FIG. 3 shows another embodiment of the present invention.

FIG. 3 shows another embodiment of the present invention in which similar parts as in FIG. 2 embodiment are indicated by similar reference numerals. In the embodiment of FIG. 3, a photosensitive member comprises an electrically conductive substrate and a photoconductive surface layer thereover. However, this embodiment may similarly utilize a photosensitive member comprising an electrically conductive substrate, a photoconductive layer and a surface insulation layer.

FIG. 3 shows rollers 23 and 24 which are rotatable in the original copy mode to convey the original 9 in the direction of arrow for scan thereof. The charger 2 is energized to uniformly charge the photosensitive member 1 in the original copy made. After this charging step, the photosensitive member 1 is exposed to the light image of the original 9 to form an electrostatic latent image corresponding to the original 9 thereon. The light image of the original 9 is projected onto the photosensitive member 1 through an imaging optical system 12' which comprises a number of small-diameter imaging elements such as gradient index type light conducting elements disposed in one or more rows.

In the information recording mode, on the other hand, the charger 2 is inoperative. Instead, an ion generator 25 is energized to form an electrostatic latent image corresponding to the information signals on the photosensitive member 1. In other words, the ion generator 25 is energized in accordance with the information signals to be recorded, to produce a flow of ions modulated in accordance with the information signals and which, in turn, is applied to the photosensitive member 1. These ions have the same polarity as that of the charger 2.

Figure 4A:
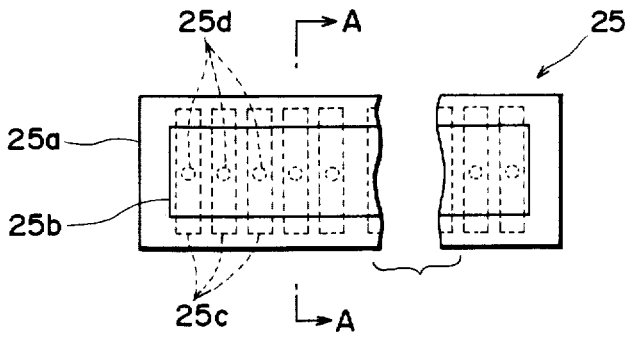
FIGS. 4A and 4B illustrate an example of an ion generator.
Figure 4B:
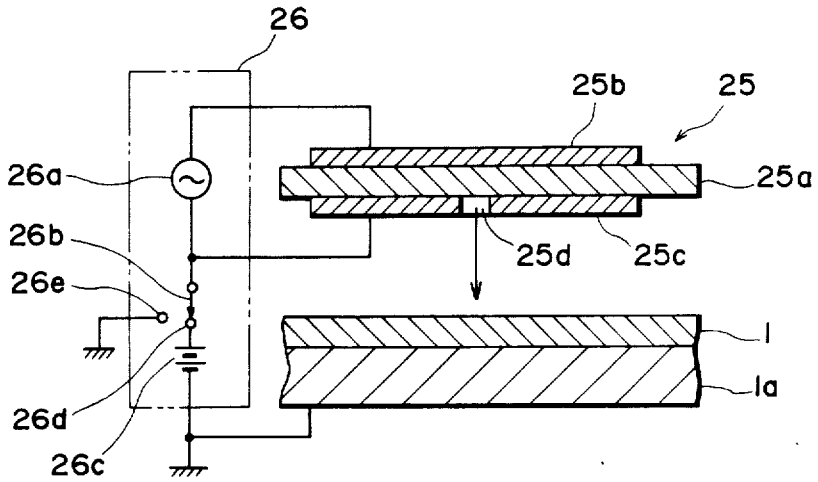

FIG. 4A is a plan view, partially broken, of the ion generator while FIG. 4B is a cross-section taken along a line A—A in FIG. 4A. The ion generator 25 comprises a dielectric member **25*a*, first and second electrodes 25*b*, 25*c* sandwiching the member 25*a* therebetween. Each of the second electrodes 25*c* is provided with an opening 25*d*. A number of such second electrodes 25*c* are disposed side by side on the dielectric member 25*a*** and spaced apart from one another.

As shown in FIG. 4B, there is provided a drive circuit 26 including a power supply **26*a* from which an alternating voltage is applied between the first and second electrodes 25*b* and 25*c*. By application of the alternating voltage between the first and second electrodes 25*b* and 25*c*, positive and negative ions are produced near the interface between the opening 25*d* of each of the second electrodes 25*c* and the dielectric member 25*a*. Switch means 26*b* is provided for each of the second electrodes 25*c*. When each of the switch means 26*b* is changed from a position in which it contacts a ground terminal 26*e* to a position in which the switch means contacts a terminal 26*d* for the power supply 26*c*, depending on information signals to be recorded, positive ions are applied to the photosensitive member 1 from the associated opening 25*d*, in the illustrated embodiment. In other words, the power supply 26*c* is connected between each of the second electrodes 25*c* and the grounded conductive support 1*a* of the photosensitive member 1 to form an electric field between the photosensitive member 1 and each of the second electrodes 25*c*. Thus, ions are drawn from the associated opening 25*d* to the photosensitive member 1. As a result, a charged area is formed on the photosensitive member 1 in the form of a spot. When one of the switches 26b is connected with the associated ground terminal 26e, the emission of ions from the associated opening 25d is stopped. If the terminal 26d of the power supply 26c is negative, the associated opening 25d** emits negative ions. Such an ion generator is disclosed in U.S. Pat. No. 4,155,093.

In any event, when the switch 26b of each of the second electrodes 25c is controlled in accordance with the information signals, an electrostatic latent image corresponding to the information signals is formed on the photosensitive member 1. In connection with this, ions are applied to the portion on the photosensitive member 1 to which toner should be attracted.

Figure 1:
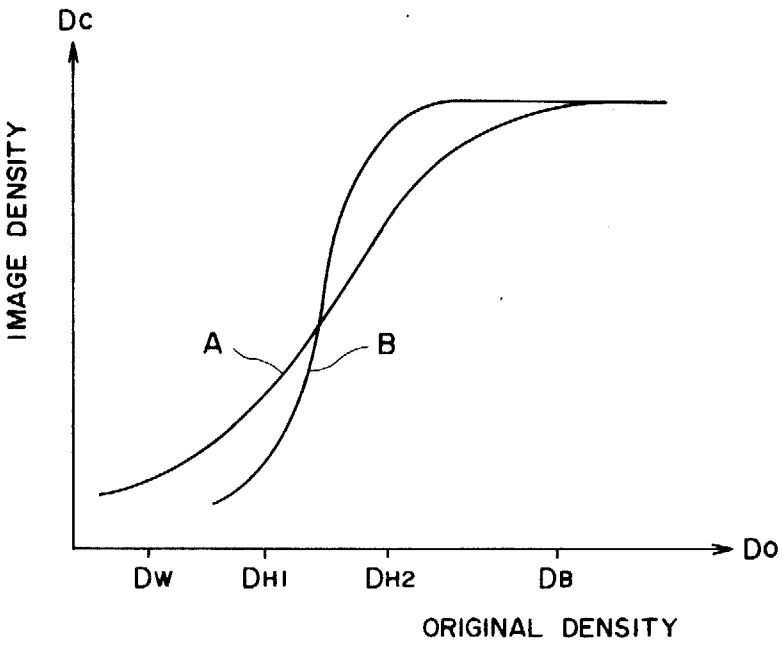
FIG. 1 illustrates $D_o-D_c$ curves.

In accordance with the present invention, the developing characteristic of the developing device 4 is made changeable such that where a latent image corresponding to an original is formed through an optical system, the characteristic is set to follow the $D_o-D_c$ curve A in FIG. 1, while where a latent image is formed in accordance with the electrical information signals such as letters, symbols or the like, the characteristic is set to follow the $D_o-D_c$ curve B shown in FIG. 1.

Figure 5:
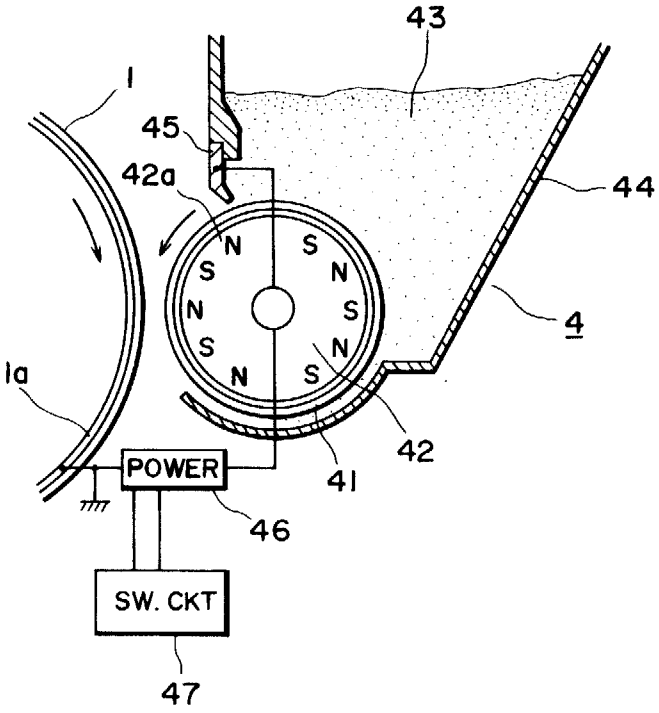
FIG. 5 shows an example of a developing device.

FIG. 5 shows an example of the developing device 4 having a function for changing the characteristics of development depending on the selected mode. This developing device 4 includes a rotatable nonmagnetic sleeve 41 which is opposed to the photosensitive member 1 and in which a magnet 42 is disposed. The sleeve 41 not only serves to carry the developer, but also functions as a development electrode.

There is a minimum gap of 300μ between the photosensitive member 1 and the sleeve 41, which is maintained by a well-known gap maintaining means.

A development vessel 44 contains one-component magnetic developer or toner 43 which includes 70% by weight of styrene maleate resin, 25% by weight of ferrite, 3% by weight of carbon black and 2% by weight of negative charge control agent all of which are ground and mixed together. This toner further contains 0.2% by weight of colloidal silica added thereto to improve the flowability.

A blade 45 of a magnetic material such as iron or the like is located opposed to the primary pole 42a (850 Causses) of the magnet 42 mounted within the sleeve 41. This blade 45 produces such a magnetic force that controls the magnetic developer 43 applied to the sleeve 41 with respect to thickness (see U.S. Pat. No. 4,386,577). Gap between the blade 45 and the sleeve 41 is maintained about 240μ. The thickness of the developer layer applied to the sleeve 41 by the blade 45 is smaller than the gap between the photosensitive member 1 and the sleeve 41, about 100μ.

A variable power source of alternating voltage 46 is interposed between the grounded electrode 1a of the photosensitive member 1 used as its base plate and the conductive portion of the sleeve 41. An alternating voltage is applied to the sleeve 41 from the variable source 46. Further, the potential on the blade 45 is the same as that of the sleeve 41 to prevent any irregular application of the developer.

Figure 6:
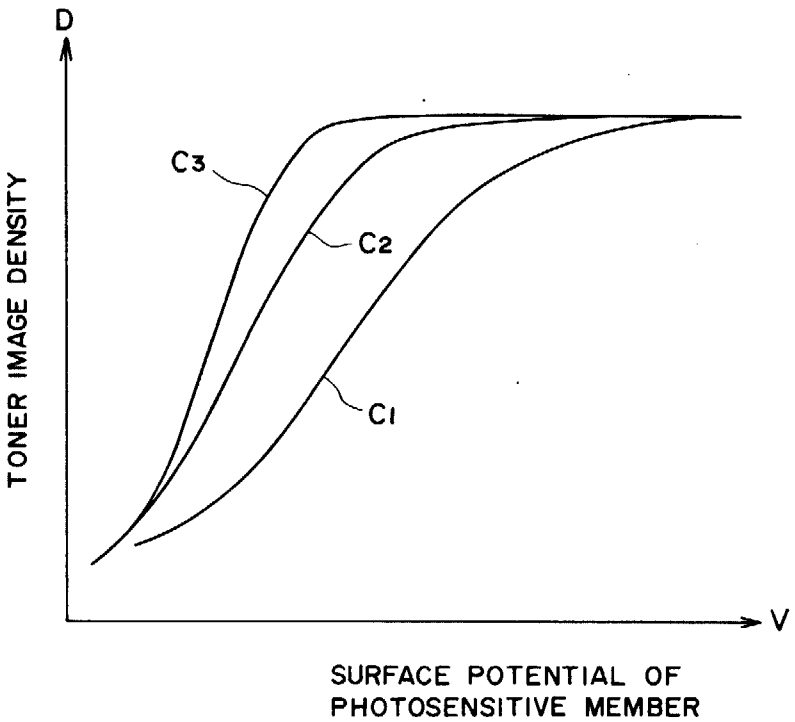
FIG. 6 illustrates V−D curves.

By changing the above alternating voltage with respect to frequency f and amplitude Vpp, the characteristics of development can be changed. This is illustrated in FIG. 6 which shows curves representing the relationship between the surface potential V of the photosensitive member and the density D of the toner image, these curves being called V−D curves hereinafter.

When the sleeve 41 is energized by an alternating voltage having relatively low frequency and amplitude, an image having a soft tone and rich gradation can be obtained. On the contrary, when the sleeve 41 is energized by an alternating voltage having relatively high frequency and amplitude, a hard-tone image having a poor gradation can be obtained. For example, for three different alternating voltages of f=600 Hz, Vpp=1000 V; f=1200 Hz, Vpp=1400 V; and f=2000 Hz, Vpp=1800 V to be applied to the sleeve 41 there are obtained V−D curves $C_1$, $C_2$ and $C_3$ shown in FIG. 6. Thus, in the original copy mode, the alternating voltage is set at relatively low frequency f and amplitude Vpp (for example, f=600 Hz and Vpp=1000 V) to develop a latent image, so that there will be obtained a toner image having its density in accordance with the $D_o-D_c$ characteristics following the curve A shown in FIG. 1. In the information recording mode, the alternating voltage is set at relatively high frequency and amplitude (for example, f=2000 Hz and Vpp=1800 V) to develop a latent image, so that there will be formed a toner image having its density in accordance with the characteristic curve following the $D_o-D_c$ curve B shown in FIG. 1. In either of the operation mode, therefore, optimum images can be obtained at all times.

As shown in FIG. 5, there is provided a switching circuit 47 for changing the frequency f and amplitude Vpp in the source of alternating voltage 46 in accordance with the selected mode. The switching circuit 47 is actuated by a mode selection switch (not shown) in an operation panel (not shown), and a bias voltage to be applied to the sleeve 41 is changed in accordance with the selected mode.

Figure 7:
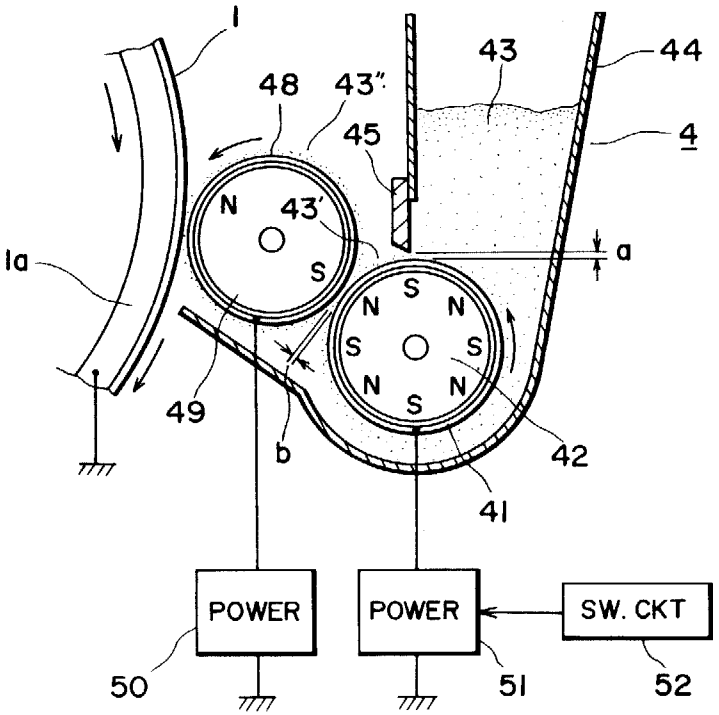
FIG. 7 shows still another embodiment of the present invention.

FIG. 7 shows another embodiment of the developing device 4 according to the present invention, which comprises an application sleeve similar to the sleeve 41 of the developing device shown in FIG. 5 and an additional development sleeve 48 receiving the toner from the application sleeve 41. The development sleeve 48 includes a fixed magnet 49 mounted therein. There are a gap a between the application sleeve 41 and the blade 45 and a gap b between the application sleeve 41 and the development sleeve 48.

In the developing device of FIG. 7, as the application sleeve 41 rotates (counterclockwise similarly to the developing sleeve 48 in the illustrated embodiment), magnetic brushes 43' held on the application sleeve and rotationarily moved therewith abut the surface of the developing sleeve 48, causing triboelectrification in the dielectric developer. At the same time, a film of developer 43" is applied to the surface of the development sleeve 48 under the action of image force and others.

The developer film 43" thus formed on the surface of the development sleeve 48 is then moved to the developing position as the development sleeve 48 is rotated. In this connection, the gap between the sleeve 48 and the photosensitive member 1 is larger than the thickness of the film 43".

The development sleeve 48 functioning also as a development electrode is energized by an alternating voltage used as a development bias, for example, an alternating voltage having a frequency of 1000 Hz and a peak-to-peak voltage Vpp of 2000 V from a first bias source 50. Under the action of this alternating bias voltage, a latent image is developed in the same manner as described hereinbefore. The application sleeve 41 is energized by a D.C. voltage from a second of bias voltage source 51 for toner application. According to experiments, when a high-dielectric and magnetic toner to be charged into negative polarity was used, the layer of toner 43'' had a thickness of about 100 μm in a case where the voltage of the application sleeve 41 was zero. When a voltage +500 V was applied to the application sleeve 41, the toner layer 43'' on the development sleeve 48 had a thickness of about 80 μm. When a bias voltage −500 V was applied to the application sleeve 41, the thickness of the toner layer 43'' on the surface of the development sleeve 48 was about 150 μm.

It is believed that the reason that the thickness of the toner layer 43'' on the sleeve 48 is changed by varying D.C. voltage to be applied to the application sleeve 41 is because, when the magnetic brushes 43' on the application sleeve 41 form the toner layer on the developing sleeve 48, there is produced a drawing or attracting force between the development and application sleeves 48, 41 under the action of the electric field therebetween such that the toner on the development sleeve 48 is turned back to the application sleeve 41 or the toner is more strongly attracted to the development sleeve 48.

In any event, by changing the bias voltage to be applied to the application sleeve 41, the toner layer 43'' to be applied to the surface of the development sleeve 48 can be varied in thickness. Therefore, the characteristics of development can correspondingly be changed as a latent image on the photosensitive member is developed.

When the thickness of the toner layer 43'' on the development sleeve surface is changed to 80 μm, 100 μm and 150 μm, respectively, the respective V−D curves can follow the curves $C_1$, $C_2$ and $C_3$ as shown in FIG. 6. If the V−D curve follows the curve $C_1$ of FIG. 6 having the excellent gradation, the $D_o-D_c$ curve will follow the curve A shown in FIG. 1. If the V−D curve follows the curve $C_3$ representing a very hard-tone reproduction, the $D_o-D_c$ curve will follow the curve B shown in FIG. 1.

In other words, in the original copy mode, the toner layer 43'' having a thickness of 80 μm can be formed on the surface of the development sleeve 48 when the bias voltage to be applied to the application sleeve 41 is set at +500 V, and in the information recording mode, the toner layer 43'' having a thickness of 150 μm can be formed when a voltage of −500 V is applied to the application sleeve 41. Whereby, satisfactory developed-images can be obtained at all times in either of the operation modes.

The developing device shown in FIG. 7 further comprises a circuit 52 for changing the voltage produced in a power supply 51 in accordance with the selected operation mode. This circuit 52 is actuated by a mode selection switch in an operation panel (not shown) to change the bias voltage to be applied to the sleeve 41 depending on the selected mode as in the previously described embodiments.

There was substantially no influence to the alternating electric field formed between the development sleeve 48 and the photosensitive member 1, under the application of a bias voltage to the application sleeve 41.

In the above embodiments, the area on the photosensitive member which is subjected to exposure (bright area) or lower potential region becomes the background of the image while the area on the photosensitive member which is not subjected to exposure (dark area) or higher potential region has toner attached thereto. However, the present invention can similarly be applied to the case where the toner will be attracted to the bright area while the dark area becomes the background of an image.

The laser beam scanning optical system shown in FIG. 2 may be replaced by a number of light emitting diodes disposed in one or more rows and flashingly modulated in accordance with information signals or a number of liquid crystal cells disposed in one or more rows and which are backed up by a source of light and respectively driven in accordance with information signals.

The developing device may utilize two-component developer containing a mixture of toner particles with carriers.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus selectively operable in either a first mode in which an original is to be copied or a second mode in which an information signal is to be recorded, said apparatus comprising:

a movable electrophotographic type photosensitive member;

first means for forming an electrostatic latent image corresponding to said original, on said photosensitive member, said first means being operable in the first mode;

second means for forming an electrostatic latent image corresponding to the information signal, on said photosensitive member, said second means being operable in the second mode;

means for developing latent images, said developing means including a development electrode opposed to said photosensitive member and means for applying a development alternating bias voltage to said development electrode, and means for changing a characteristic of development in said developing means in accordance with the selected mode, said changing means setting the development characteristic in said developing means to a first characteristic in the first mode and to a second characteristic in the second mode, wherein said first characteristic provides a V−D curve having a relatively gentle slope while said second characteristic provides a V−D curve having a relatively steep slope, wherein V is a surface potential of said photosensitive member and D is a density of the developed image;

wherein said changing means is adapted to set the frequency and the amplitude of said alternating bias voltage at relatively low levels in the first mode and at relatively high levels in the second mode, respectively.

2. An image forming apparatus selectively operable in either a first mode in which an original is to be copied or or a second mode in which an information signal is to be recorded, said apparatus comprising:

a movable electrophotographic type photosensitive member;

first means for forming an electrostatic latent image corresponding to said original, on said photosensitive member, said first means being operable in the first mode;

second means for forming an electrostatic latent image, corresponding to the information signal, on said photosensitive member, said second means being operable in the second mode:

means for developing latent images, said developing means including means for carrying developer to said photosensitive member and means for supplying the developer to said developer carrying means; and means for changing a characteristic of development in said developing means in accordance with the selected mode, said changing means setting the development characteristic in said developing means to a first characteristic in the first mode and to a second characteristic in the second mode, wherein said first characteristic provides a V−D curve having a relatively gentle slope while said second characteristic provides a V−D curve having a relatively steep slope, wherein V is a surface potential of said photosensitive member and D is a density of the developed image;

wherein said changing means is adapted to set the amount of developer to be supplied to said developer carrying means at a relatively small level in the first mode and at a relatively large level in the second mode.

3. An image forming apparatus as defined in claim 2, wherein said developing means includes means for applying a bias voltage to said developer supplying means and wherein said changing means is adapted to change said bias voltage in accordance with the selected mode.

* * * * *

UNITED STATES PATENT AND TRADEMARK OFFICE

CERTIFICATE OF CORRECTION

PATENT NO. : 4,701,043

DATED : October 20, 1987

INVENTOR(S) : KENZO TAKAYAMA

It is certified that error appears in the above-identified patent and that said Letters Patent is hereby corrected as shown below:

COLUMN 2

Line 19, "signal" should read --signals--.

COLUMN 3

Line 44, "particle" should read --particles--.

COLUMN 4

Line 17, "made." should read --mode.--.

COLUMN 5

Line 46, "Causses)" should read --Gausses)--.

COLUMN 6

Line 26, "mode," should read --modes,--.
Line 50, "rotationarily" should read --rotationally--.

COLUMN 8

Line 61, "or or" should read --or in--.

UNITED STATES PATENT AND TRADEMARK OFFICE

CERTIFICATE OF CORRECTION

PATENT NO. : 4,701,043

DATED : October 20, 1987

INVENTOR(S) : KENZO TAKAYAMA

It is certified that error appears in the above-identified patent and that said Letters Patent is hereby corrected as shown below:

COLUMN 9

Line 4, "mode:" should read --mode;--.

Signed and Sealed this

Fifth Day of July, 1988

*Attest:*

DONALD J. QUIGG

*Attesting Officer*

*Commissioner of Patents and Trademarks*